US007682290B2

(12) United States Patent
Liao et al.

(10) Patent No.: US 7,682,290 B2
(45) **Date of Patent: *Mar. 23, 2010**

(54) STATIONARY EXERCISE APPARATUS

(75) Inventors: Hung-Mao Liao, Taichung City (TW); Shu-Wei Chang, Taichung Hsien (TW)

(73) Assignee: Johnson Health Tech. (TW)

( * ) Notice: Subject to any disclaimer, the term of this patent is extended or adjusted under 35 U.S.C. 154(b) by 468 days.

This patent is subject to a terminal disclaimer.

(21) Appl. No.: 11/434,541

(22) Filed: May 15, 2006

(65) Prior Publication Data

US 2007/0117684 A1 May 24, 2007

(30) Foreign Application Priority Data

Nov. 4, 2005 (CN) ..... 2005 1 0115518

(51) Int. Cl.
*A63B 22/00* (2006.01)
*A63B 22/04* (2006.01)

(52) U.S. Cl. ..... 482/52; 482/51

(58) Field of Classification Search ..... 482/51–53, 482/57, 70

See application file for complete search history.

(56) References Cited

U.S. PATENT DOCUMENTS

| | | | | |
|---|---|---|---|---|
| 5,383,829 | A | 1/1995 | Miller | |
| 5,540,637 | A | 7/1996 | Rodgers, Jr. | |
| 5,573,480 | A | 11/1996 | Rodgers, Jr. | |
| 5,685,804 | A | 11/1997 | Whan-Tong et al. | |
| 5,788,609 | A | 8/1998 | Miller | |
| 5,813,949 | A | 9/1998 | Rodgers, Jr. | |
| 5,893,820 | A | 4/1999 | Maresh et al. | |
| 5,910,072 | A * | 6/1999 | Rawls et al. | 482/51 |
| 5,916,065 | A | 6/1999 | McBride et al. | |
| 5,924,962 | A | 7/1999 | Rodgers, Jr. | |
| 5,938,567 | A | 8/1999 | Rodgers, Jr. | |
| 6,004,244 | A | 12/1999 | Simonson | |
| 6,126,573 | A * | 10/2000 | Eschenbach | 482/51 |
| 6,135,926 | A * | 10/2000 | Lee | 482/57 |
| 6,146,313 | A | 11/2000 | Whan-Tong et al. | |
| 6,168,552 | B1 | 1/2001 | Eschenbach | |
| 6,341,476 | B2 * | 1/2002 | Golightly | 53/582 |
| 6,422,977 | B1 * | 7/2002 | Eschenbach | 482/52 |
| 6,440,042 | B2 | 8/2002 | Eschenbach | |
| 7,169,087 | B2 * | 1/2007 | Ercanbrack et al. | 482/52 |
| 7,278,955 | B2 * | 10/2007 | Giannelli et al. | 482/51 |
| 7,316,633 | B2 | 1/2008 | Liao et al. | |
| 2004/0209741 | A1 | 10/2004 | Kuo | |

(Continued)

FOREIGN PATENT DOCUMENTS

| | | | |
|---|---|---|---|
| CN | 2559371 | Y | 7/2003 |

(Continued)

OTHER PUBLICATIONS

Form PCT/ISA/220, Notification of Trans. of the Int'l Search Report and the Written Opinon of the Int'l Searching Authority or the Decl. rec'd Dec. 10, 2007, 3pp.

(Continued)

*Primary Examiner*—Steve R Crow
(74) *Attorney, Agent, or Firm*—Smith Law Office

(57) ABSTRACT

A stationary exercise device with adjustable members for varying the stride path and the exercise intensity of a user.

18 Claims, 15 Drawing Sheets

U.S. PATENT DOCUMENTS

2007/0099763 A1 5/2007 Wang
2009/0062081 A1* 3/2009 Liao et al. ..... 482/52

FOREIGN PATENT DOCUMENTS

CN 2571426 Y 9/2003

OTHER PUBLICATIONS

Form PCT/ISA/210, International Search Report received Dec. 10, 2007, 5pp.

Form PCT/ISA/210, Written Opinion of the Int'l Searching Authority received Dec. 10, 2007, 6pp.

Form PCT/IB/326, Notification Concerning Transmittal of International Preliminary Report on Patentability received May 29, 2008, 1p.

Form PCT/IB/373, International Preliminary Report on Patentability received May 29, 2008, 1p.

Form PCT/ISA/237, Written Opinion of the International Searching Authority received May 29, 2008, 6pp.

* cited by examiner

STATIONARY EXERCISE APPARATUS

BACKGROUND OF THE INVENTION

This invention relates to a stationary exercise apparatus, and more particularly to a stationary exercise apparatus with adjustable components to vary the footpath and enhance exercise intensity of a user.

Stationary exercise apparatus have been popular for several decades. Early exercise apparatus typically had a single mode of operation, and exercise intensity was varied by increasing apparatus speed. More recently, enhancing exercise intensity in some apparatus has been made by adjusting the moving path of user's feet, such as by adjusting the incline or stride length of user's foot path.

U.S. Pat. No. 5,685,804 discloses two mechanisms for adjusting the incline of a stationary exercise apparatus, one of them having a linear track which can be adjusted and the other having a length adjusting swing arm. The swing arm lower end can be moved upwardly for a high incline foot path. U.S. Pat. No. 6,168,552 also discloses a stationary exercise apparatus having a linear track for changing the incline of the stationary exercise apparatus. U.S. Pat. No. 6,440,042 discloses a stationary exercise apparatus having a curved track for adjusting the incline of the stationary exercise apparatus.

Nonetheless, there is still a need for an exercise apparatus that can increase varieties of exercise and enhance exercise intensity of a user.

SUMMARY OF THE INVENTION

A stationary exercise apparatus in accordance with present invention includes a frame having a base, first and second supporting members coupled to the frame to rotate about an axis, first and second swing members adjustably and pivotally connecting the first and second supporting members and the frame, and first and second pedals directly or indirectly coupled to the first and second supporting members. While operating the stationary exercise apparatus, the first and second pedals move along a closed path that can have a variety of shapes to vary the exercise experience and intensity. Several objects and advantages of the present invention are: (a) to provide a user of the stationary exercise apparatus with a benefit of high exercise intensity; (b) to provide a user of the stationary exercise apparatus with a benefit of an inclined foot path; (c) to provide a user of the stationary exercise apparatus with a benefit of an variable stride length; and (d) to provide a user of the stationary exercise apparatus with a benefit of better gluteus exercise. Further features, aspects, and advantages of the present invention are described and illustrated herein.

DESCRIPTION OF THE PREFERRED EMBODIMENTS

Figure 1:
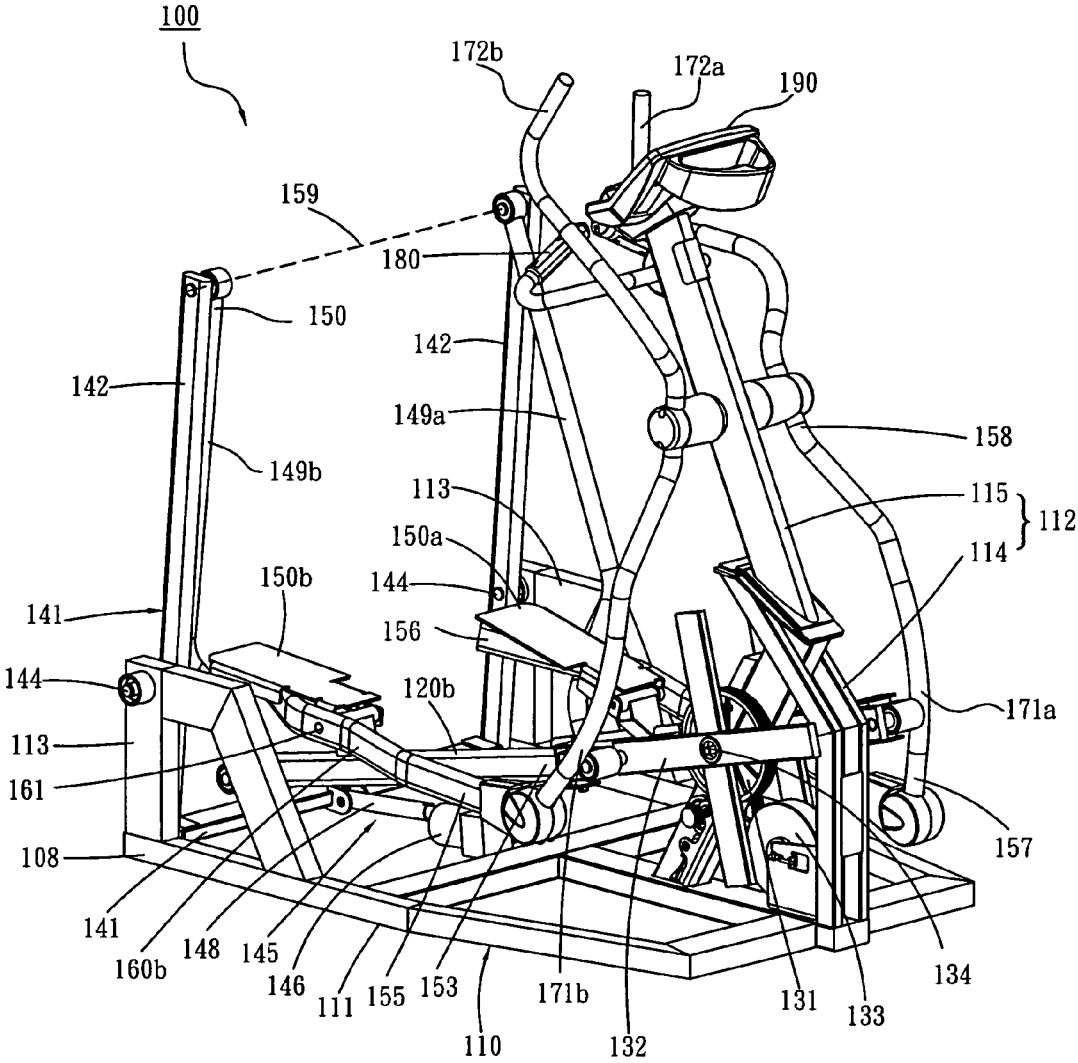
FIG. 1 is a perspective view of a stationary exercise apparatus according to a preferred embodiment of the present invention.

Referring now specifically to the figures, in which identical or similar parts are designated by the same reference numerals throughout, a detailed description of the present invention is given. It should be understood that the following detailed description relates to the best presently known embodiment of the invention. However, the present invention can assume numerous other embodiments, as will become apparent to those skilled in the art, without departing from the appended claims.

Now referring to FIG. 1, a stationary exercise apparatus 100 is illustrated therein. The stationary exercise apparatus 100 has a frame 110 generally comprising a base 111, a front portion 112, a rear portion 108, and side portions 113. The base 111 is substantially a horizontal frame adapted to stably rest on a ground, floor or other similar supporting surface. The front portion 112 is fixed on the base 111, and preferably includes a post 114 and a standard 115. The side portions 113 are respectively mounted on the left and right sides of the base portion 111. A fixed handle assembly 180 and a console 190 are mounted on or near the upper end of the standard 115. Left and right cranks 132 are each pivoted to one portion of the frame 110 defining a first axis 134 and in the illustrated embodiment, the first axis 134 is at or near the front portion of the frame 110. The left and right cranks 132 could be replaced by a pair of disks or flywheels rotating about the first axis 134. The left and right cranks 132 and the first axis 134 can also be replaced by a pair of closed tracks circulating about a virtual axis. The frame 110 may further comprise a pulley 133 and a resistance member 135 which is controlled by using the console 190 to vary operating resistance for a user.

Figure 2:
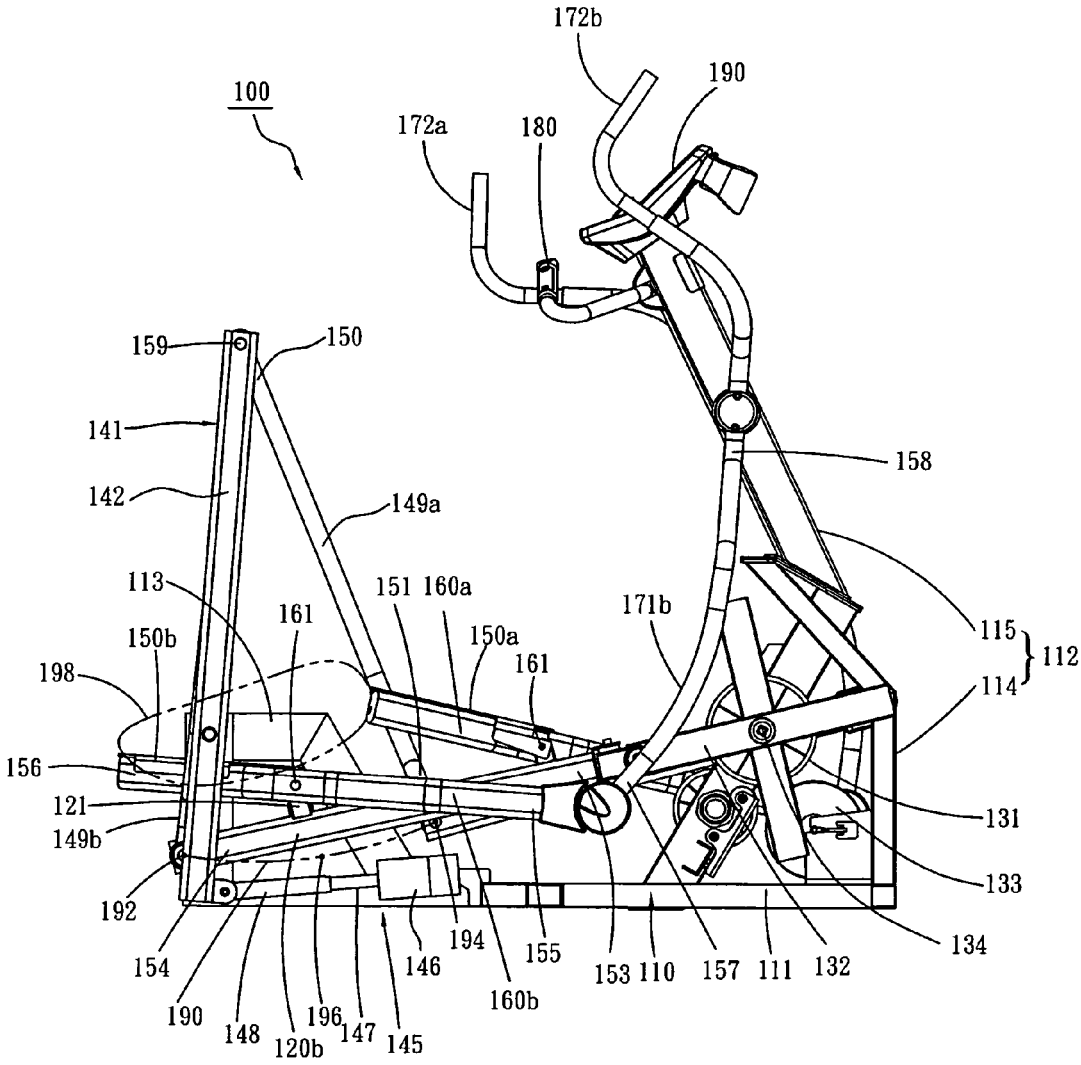
FIG. 2 is a side view of the stationary exercise apparatus of FIG. 1 in a rotating position of a low incline condition.
Figure 3:
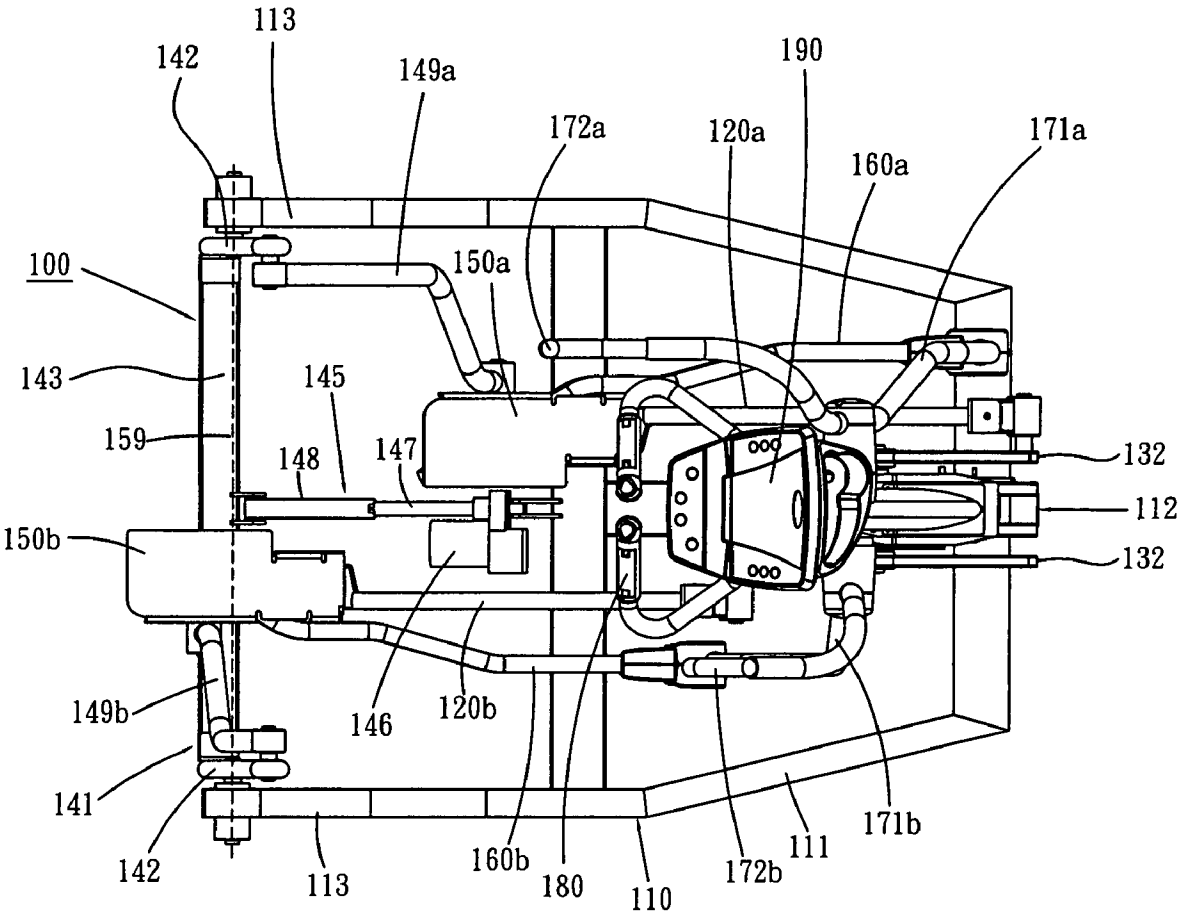
FIG. 3 is a top view of the stationary exercise apparatus of FIG. 1.
Figure 6:
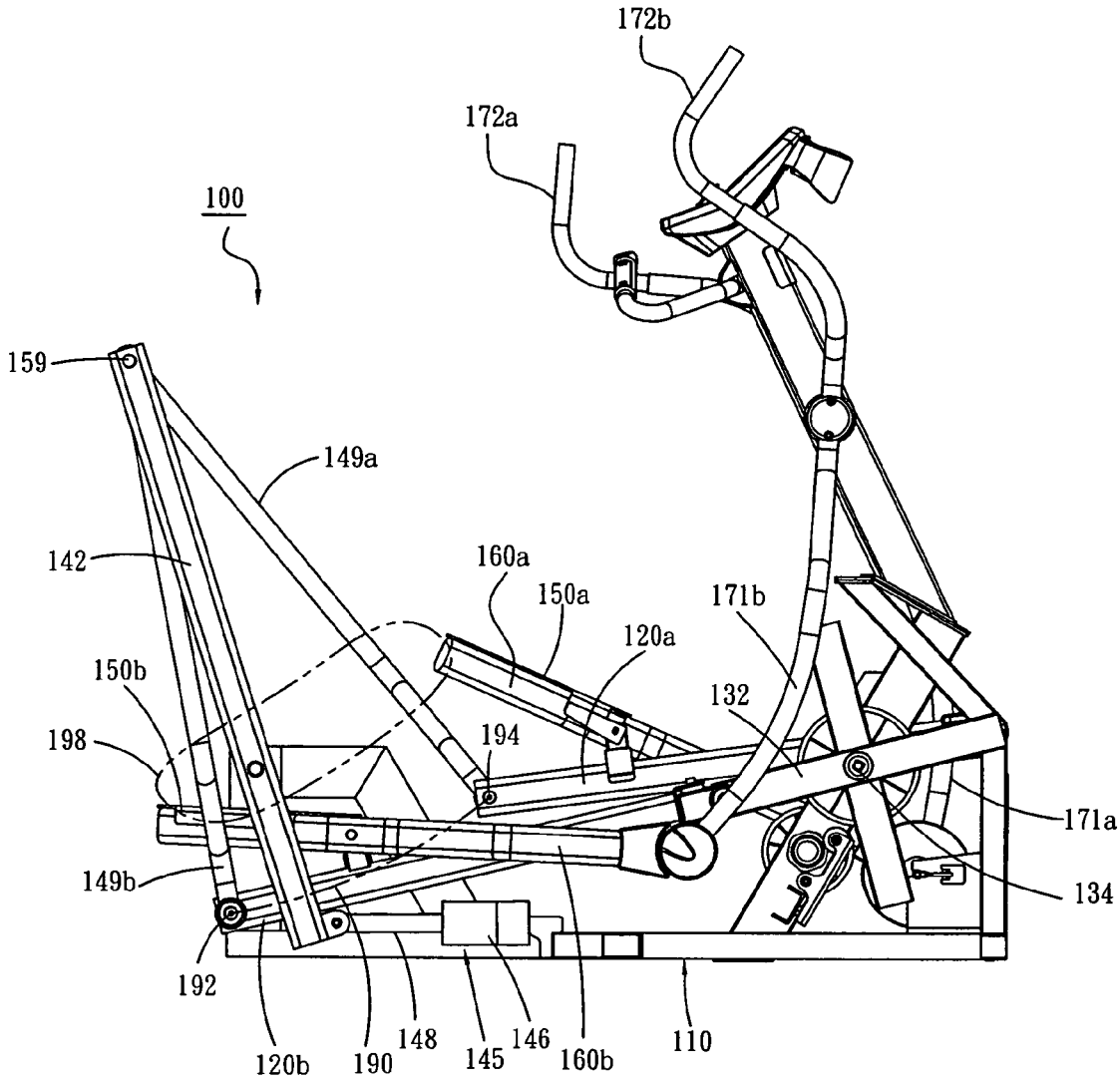
FIG. 6 is a side view of the stationary exercise apparatus of FIG. 1 in a rotating position of a high incline condition.

Now referring to FIGS. 1 and 2, the frame 110 further comprises a moving assembly 141 mounted on the side portions 113 respectively. In a preferred embodiment of the present invention as shown in FIG. 1, the moving assembly 141 has first and second moving members 142, in a generally upright position, and a lateral link 143 (FIG. 4) connecting the first and second moving members 142 to one another. The first and second moving members 142 are joined to the side portions 113 via a second axis 144 so that the upper end portions of the first and second moving members 142 can be adjusted by pivoting the first and second moving members 142 about the second axis 144. There is an optional adjusting assembly 145 mounted between the moving assembly 141 and the frame 110 for adjusting the moving assembly 141 about the second axis 144. The preferred embodiment of the adjusting assembly 145 generally includes a motor 146, a screw rod 147, and a screw tube 148. The motor 146 has one end connected to the base portion 111 and the other end connected to one end of the screw rod 147. The other end of the screw rod 117 is connected to one end of the screw tube 148. The other end of the screw tube 148 is connected to the moving assembly 141 so that the effective length of the screw rod 147 and the screw tube 148 combination is adjustable to move the lower end of the first and second moving members 142 fore and aft. As the lower ends move, the upper ends of the first and second moving members 142 are pivoted in the opposite direction about the second axis 144. The upper end portions of the first and second moving members 142 are adjustable anywhere between a first position as shown in FIG. 2 and a second position as shown in FIG. 6. Although described and illustrated as a screw adjusting mechanism, the adjusting assembly 145 could be any manual or automatic mechanical, electromechanical, hydraulic, or pneumatic device and be within the scope of the invention. The adjusting assembly 145 is illustrated as being mounted on the right side of the exercise device 100, but both moving members 142 are adjusted because a lateral link 143 (FIG. 4) transfers the force to the left side moving member 143.

Figure 4:
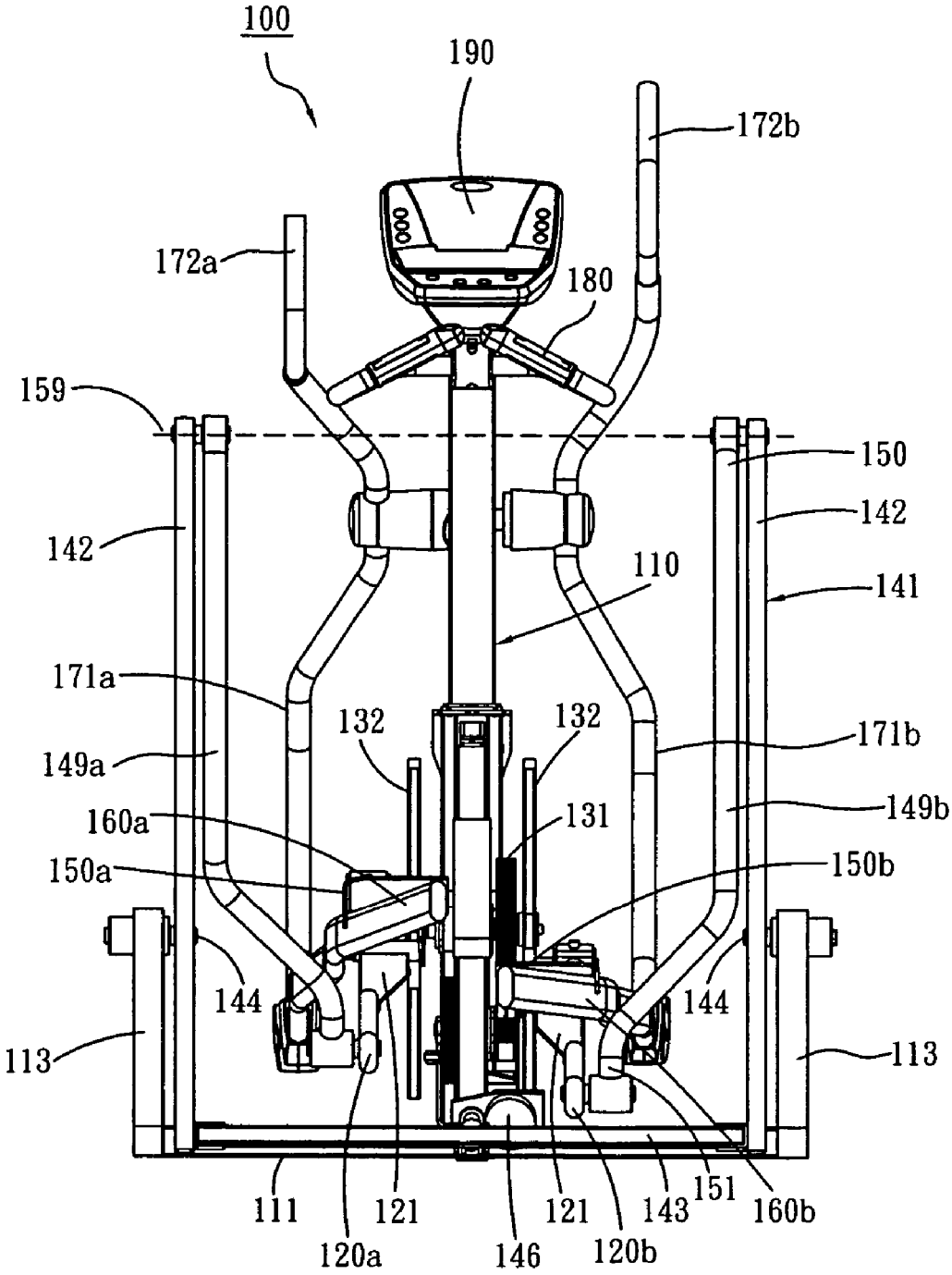
FIG. 4 is a back view of the stationary exercise apparatus of FIG. 1.

Referring to FIGS. 2 and 4, the stationary exercise apparatus 100 comprises first and second swing members 149*a*/149*b*, each of the swing members 149*a*/149*b* having an upper portion 150 and a lower portion 151. The upper portions 150 of the first and second swing members 149*a*/149*b* can be coupled to the frame 110 via a swing axis 159 for swinging motion relative to the frame. In the preferred embodiment of the present invention, the upper portions 150 of the first and second swing members 149*a*/149*b* are respectively pivoted to the first and second moving members 142 via the swing axis 159 so that the swing axis 159 can be adjusted forward or backward anywhere between the first position shown in FIG. 2 and the second position shown in FIG. 6. Different positions of the swing axis 159 cause different exercise intensity of the stationary exercise apparatus 100.

Figure 5:
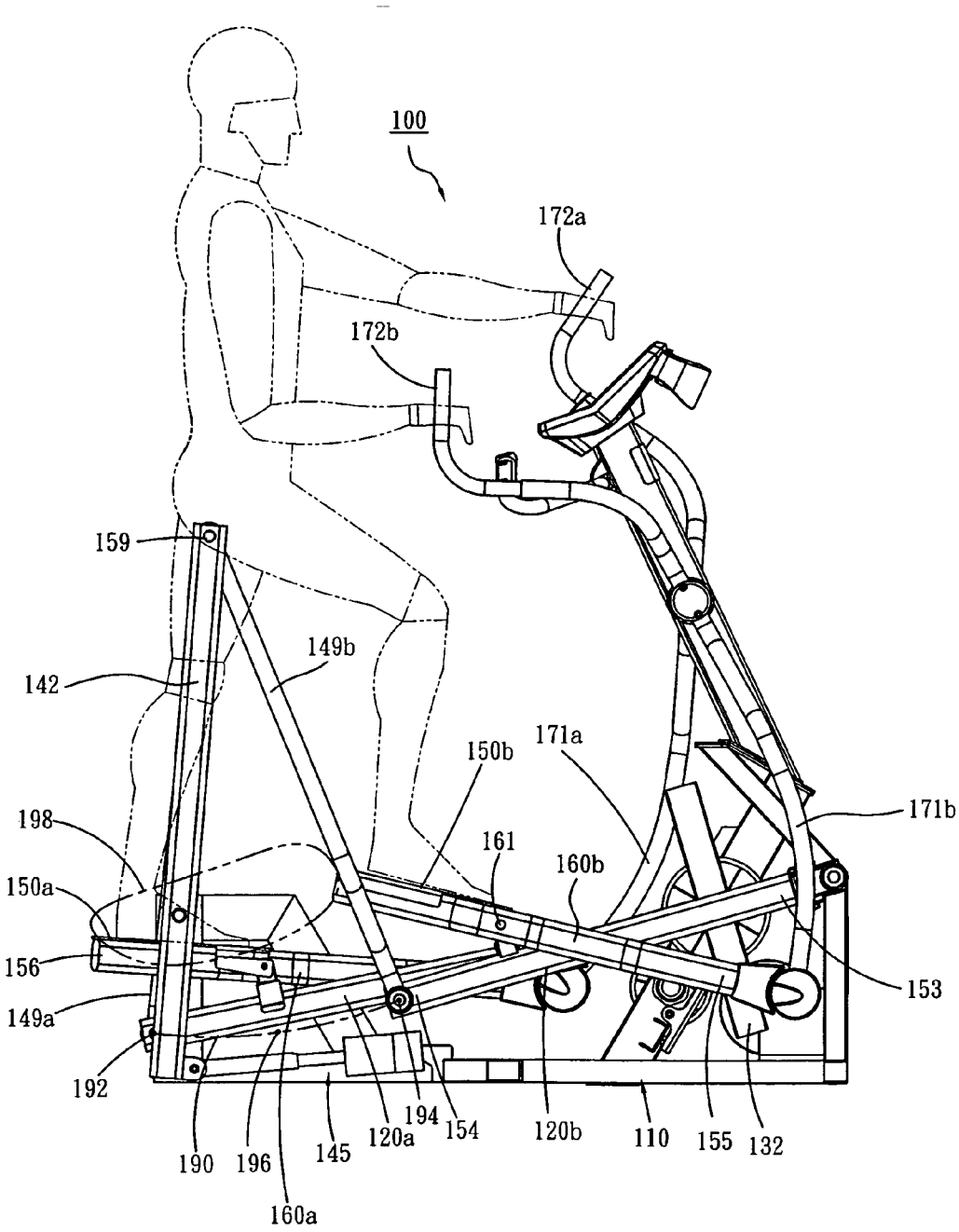
FIG. 5 is a side view of the stationary exercise apparatus of FIG. 1 in another rotating position of the low incline condition.

Now referring to FIGS. 2, 4 and 5, the stationary exercise apparatus 100 comprises first and second supporting members 120*a*/120*b*, each of the first and second supporting members 120*a*/120*b* having a first end portion 153 and a second end portion 154. The first end portions 153 of the first and second supporting members 120*a*/120*b* are respectively coupled to the frame 110 to rotate about the first axis 134. In the preferred embodiment of the present invention, the first end portions 153 of the first and second supporting members 120*a*/120*b* are respectively pivoted to the left and right cranks 132 to rotate about the first axis 134. As mentioned previously, the left and right cranks 132 may be replaced by flywheels or disks and the like. The second end portions 154 of the first and second supporting members 120*a*/120*b* are respectively pivoted to the lower portions of the first and second swing members 149*a*/149*b* so that the second end portions 154 of the first and second supporting members 120*a*/120*b* may be moved along a reciprocating path 190 (as shown in FIGS. 2 and 5) while the first end portions 153 of the first and second supporting members 120*a*/120*b* are being rotated about the first axis 134.

Referring to FIGS. 1 through 6, the stationary exercise apparatus 100 further comprises first and second control links 160*a*/160*b* respectively pivotally connected to the first and second supporting members 120*a*/120*b*. Each of the first and second control links 160*a*/160*b* has a first end portion 155 and a second end portion 156. The first end portions 155 of the first and second control links 160*a*/160*b* are movably coupled to the frame 110. In the preferred embodiment of the present invention, the first end portions 155 of the first and second control links 160*a*/160*b* are respectively connected to first and second handle links 171*a*/171*b*. More specifically, each of the first and second handle links 171*a*/171*b* has lower and upper end portions. The lower end portions 157 of the first and second handle links 171*a*/171*b* are respectively pivoted to the first end portions 155 of the first and second control links 160*a*/160*b* and the upper end portions 158 of the first and second handle links 171*a*/171*b* are pivoted to the frame 110 so that, the first and second handle links 171*a*/171*b* can guide the first end portions 155 of the first and second control links 160*a*/160*b* in a reciprocating path. There are several alternatives of performing the same function of the first and second handle links 171*a*/171*b*. For example, the frame 110 can include a pair of tracks allowing the first end portions 155 of the first and second control links 160*a*/160*b* movably coupled to the tracks via rollers or sliders. For simplicity, all such alternatives are referred to herein as "handle links" even when they do not serve as handles for the user.

Still referring to FIGS. 1 through 6, the stationary exercise apparatus 100 includes first and second pedals 150*a*/150*b* respectively coupled to the first and second supporting members 120*a*/120*b*. In the preferred embodiment of the present invention, the first and second pedals 150*a*/150*b* are indirectly connected to the first and second supporting members 120*a*/120*b*. More specifically, the first and second pedals 150*a*/150*b* are respectively attached to the second end portions 156 of the first and second control links 160*a*/160*b* which are pivotally connected to the first and second supporting members 120*a*/120*b*. Therefore, rear end portions 158 of the first and second pedals 150*a*/150*b* are directed by the first and second supporting members 120*a*/120*b* to move along a second closed path 198 (FIGS. 2, 5, and 6) while the first end portions 153 of the first and second supporting members 120*a*/120*b* rotating about the first axis 134. The first and second pedals 150*a*/150*b* can also be directly attached to the first and second supporting members 120*a*/120*b*, similar to the teaching of U.S. Pat. No. 5,685,804. It should be noticed that both indirect and direct connections between the first and second pedals 150*a*/150*b* and the first and second supporting members 120*a*/120*b* can cause the rear end portions of the first and second pedals 150*a*/150*b* to move along similar closed paths, and are within the scope of the present invention.

Now referring to FIGS. 2 and 5, the reciprocating path 190 of the first and second swing members 149*a*/149*b* has a rear end 192, a front end 194, and a middle point 196. The middle point 196 is substantially the middle point between the rear end 192 and the front end 194. As shown in FIG. 2, the second end portion of the second support member 120*b* is being at the rear end 192 of the reciprocating path 190 while the first end of the second supporting member 120*b* is being approximately at the rearmost position during rotating about the first axis 134. As also shown in FIG. 5, the second end of the second support member 120*b* is being at the front end 194 of the reciprocating path 190 while the first end of the second supporting member 120*b* is being approximately at the foremost position during rotating about the rotating axis 134. In the preferred embodiment of the present invention, the reciprocating path 190 is substantially arcuate because of the swing motion of the first and second swing members 149*a*/149*b*, but the present invention is not limited to the first and second swing members 149*a*/149*b* having an arcuate reciprocating path. It should be noticed that relative positions between the swing axis 159 and the reciprocating path 190 can cause different exercise intensity of the stationary exercise apparatus 100.

More specifically, the positions of the swing axis 159 can determine incline levels of both the reciprocating path 190 and the second closed path 198. If the swing axis 159 is substantially vertically above the middle point 196 of the reciprocating path 190, the incline level of both the reciprocating path 190 and the second closed path 198 are substantially horizontal. If the swing axis 159 is positioned rearwardly in view of an orientation of an operating user, the incline levels of both the reciprocating path 190 and the second closed path 198 are increased. A higher incline level of the second closed path 198 creates higher exercise intensity of a user. As shown in FIG. 2, the swing axis 159 is positioned slightly in back of the middle point 196 of the reciprocating path 190 so that the second closed path 198 is slightly inclined and the exercise intensity is enhanced. In order to obtain higher exercise intensity, the swing axis 159 can be re-positioned farther toward the rear. As shown in FIG. 6, the swing axis 159 is in back of the rear end 192 of the reciprocating path 190 and both the reciprocating path 190 and the second closed path 198 are in a relatively high incline level so that the exercise intensity of the stationary exercise apparatus 100 is further increased.

In a preferred embodiment of the present invention, the adjusting assembly 145 can be controlled via the console 199 to vary the incline level of the second closed path 198 and to adjust the exercise intensity of the stationary exercise apparatus 100. As mentioned previously, the upper portions 150 of the first and second swing members 149*a*/149*b* are coupled to the moving assembly 141 of the frame 110. The adjusting assembly 145 is connected between the lateral link 143 (FIG. 5) of the moving assembly 141 and the frame 110. Therefore, a user can electronically actuate the adjusting assembly 145 to vary the position of the swing axis 159 and adjust the incline level of the second closed path 198. It should be noted that the (lateral) link 143 could be omitted in some embodiments, not shown in the figures. For example, two adjusting assemblies 145 are directly connected to the first and second moving members 142 respectively. The benefit of omitting the (lateral) link 143 is that the height of the first and second pedal 150*a*/150*b* could be lower because of less interference between the (lateral) link 143 and the second end portions of the first and second supporting members 120*a*/120*b*. A user may feel more comfortable in a lower operating position. It should also be noticed that the incline level of the stationary exercise apparatus 100 is not limited to an electronically adjustment. Some manual adjustments, such as pin and holes combinations, levers, cranks and the like are also within the scope of the present invention.

FIG. 5 shows the swing axis 159 is positioned to the rear of the middle point 196 of the reciprocating path 190 and the second closed path 198 is in a low incline level. FIG. 6 shows the swing axis 159 is positioned to the rear of the rear end 192 of the reciprocating path 190 and the second closed path 198 is in a higher incline level. In other embodiments of the present invention, the incline level of the second closed path 198 could also be non-adjustable. For example, the side portions 113 of the frame 110 extend upwardly and the first and second swing members 149*a*/149*b* are directly pivoted to the side portions 113 of the frame 110. In the non-adjustable embodiments, when the swing axis 159 is positioned slightly in back of the middle point 196, the second closed path 198 is in the low incline level, not flat, such as shown in FIG. 5. When the swing axis 159 is positioned in back of the rear end 192 of the reciprocating path 190, the second closed path 198 would be in the high incline level as shown in FIG. 6. Both the low and high incline level of the stationary exercise apparatus 100 can enhance exercise intensity of a user, comparing to a more horizontal incline level.

To operate the stationary exercise apparatus 100, a user respectively steps on the first and second pedals 150*a*/150*b* and grabs on the fixed handle assembly 180 or a pair of moving handles 172*a*/172*b*. The first end portions 153 of the first and second supporting members 120*a*/120*b* rotate along a substantially arcuate path about the first axis 134 and the second ends of the first and second supporting members 120*a*/120*b* move along the reciprocating path 190. Therefore, rear end portions of the first and second pedals 150*a*/150*b* move along the second closed path 198. As mentioned previously, the positions of the swing axis 159 are relative to some geometry parameters of the second closed path 198 and have great effects on the exercise intensity of a user of the stationary exercise apparatus 100.

Figure 8:
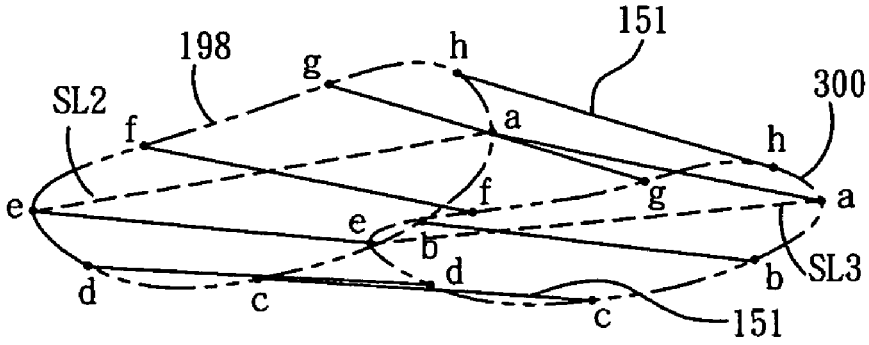
FIG. 8 are toe and heel path profiles of the stationary exercise apparatus of FIG. 1 in a relatively low incline condition.
Figure 9:
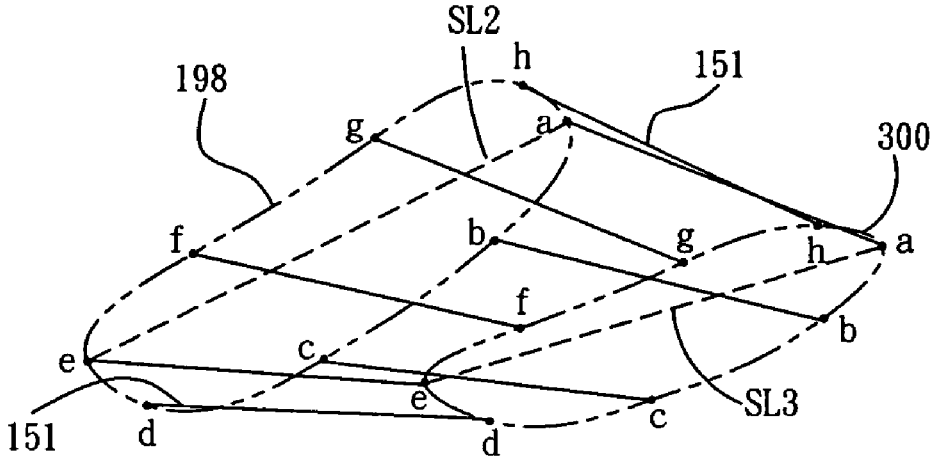
FIG. 9 are toe and heel path profiles of the stationary exercise apparatus of FIG. 1 in a relatively high incline condition.
Figure 10:
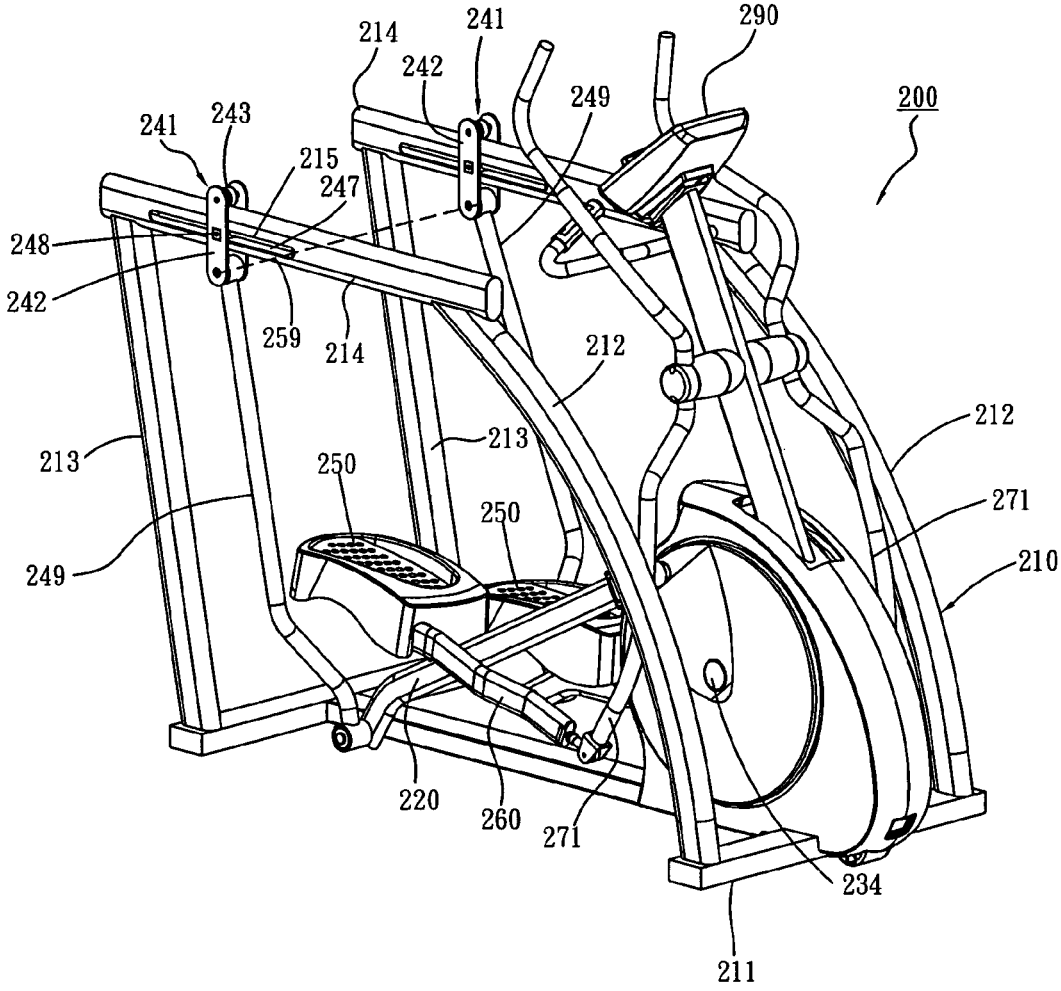
FIG. 10 is a perspective view of a stationary exercise apparatus according to another embodiment of the present invention.
Figure 11:
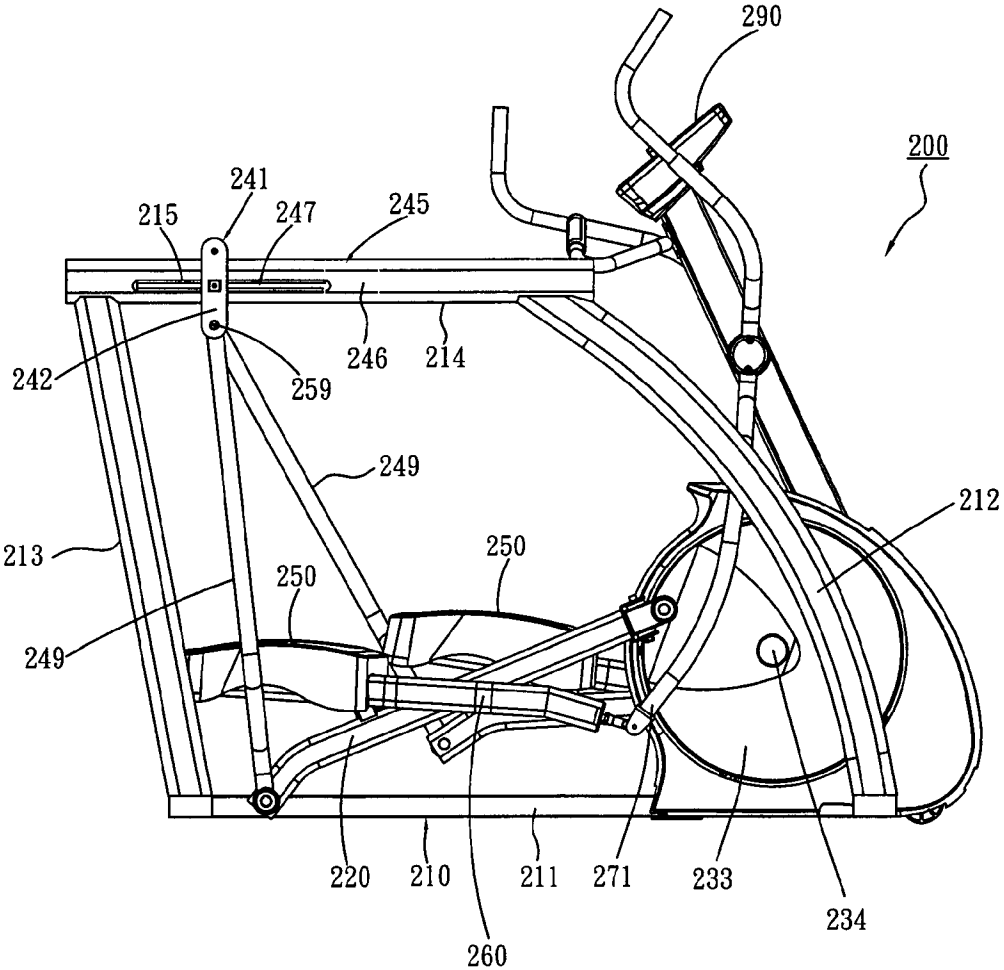
FIG. 11 is a side view of the stationary exercise apparatus of FIG. 10.
Figure 12:
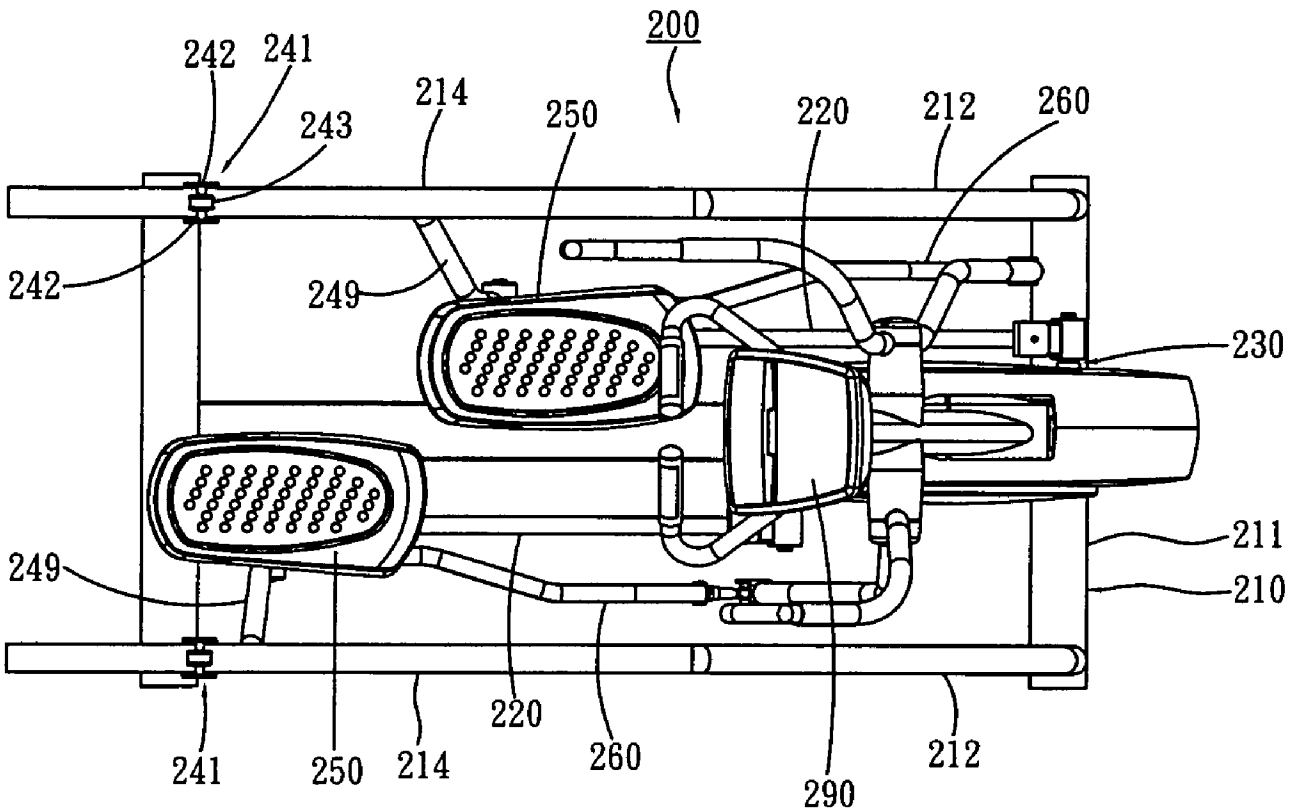
FIG. 12 is a top view of the stationary exercise apparatus of FIG. 10.

To better present the relationship between the swing axis 159 and the second closed path 198, separated path information is illustrated in FIGS. 8 and 9. FIG. 8 shows the path information and geometry parameters while the swing axis 159 is slightly in back of the middle point 196 as shown in FIG. 5. FIG. 9 shows the path information and geometry parameters while the swing axis 159 is to the rear of the rear end 192.

Now referring to FIG. 8 in more detail, the second closed path 198 is represented by eight correspondent points, a~h. The correspondent points a and e are the foremost and rearmost positions of the first ends of the first and second supporting members 120*a*/120*b* during rotating about the first axis 134. Each point is separated in an equal angle of forty-five degrees relative to the angle of rotation about the first axis 134. A stride length SL2 constituted by the correspondent points a and e is also one of the geometry parameters of the second closed path 198, in addition to the incline level. The stride length SL2 is substantially the stride length of the heel portion of a user because the second closed path 198 is the moving path of the rear ends of the pedals 150*a*/150*b* and the heel portion of a user is approximate to the rear ends of the pedals 150*a*/150*b*. Stride length is also relative to exercise intensity. A longer stride length generally results in higher exercise intensity. A third closed path 300 is the moving path of the front ends of the pedals 150*a*/150*b*. A stride length SL3 may also substantially represent the stride length of the toe portion of a user. Because the closed paths 198 and 300 are moving paths of the rear and front ends of the pedals 150*a*/150*b*, the orientation of the pedals 150*a*/150*b* can be illustrated by a pedal orientation 151 as shown in FIG. 8. One important character of the pedal orientation 151 is that the steepness of the pedal orientation 151 is increased when the swing axis 159 is adjusted backwardly.

Figure 7:
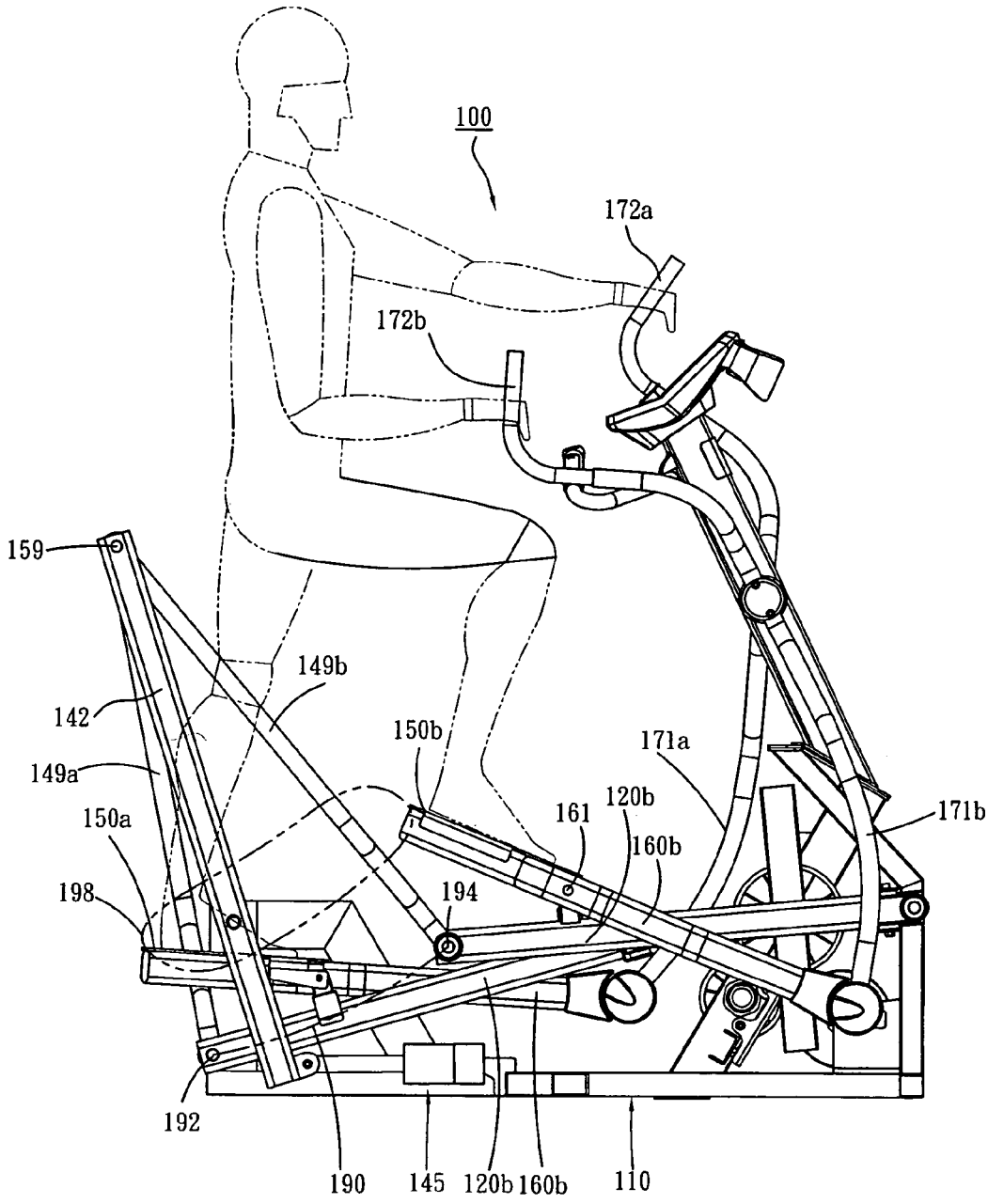
FIG. 7 is a side view of the stationary exercise apparatus of FIG. 1 in another rotating position of the high incline condition demonstrating better gluteus exercise of a user.

Now referring to FIGS. 7 and 9 show the stride length SL2, stride length SL3, pedal orientation 151, second closed path 198, and third closed path 300 while the swing axis 159 is in back of the rear end 192 of the arcuate path 190. As shown in FIG. 7, the first and second control links 160*a*/160*b* are respectively pivoted to the first and second supporting members 120*a*/120*b* via pivot axes 161. The incline level of the second closed path 198 of FIG. 9 is increased by 17 degrees compared to the incline level of FIG. 8, but the incline level of the third closed path 300 of FIG. 9 is only increased by 11 degrees. That is, the incline level of the second closed path 198 is increased more than the incline level of the third closed path 300 while the swing axis 159 is being adjusted backwardly. The stride length SL2 of FIG. 9 is increased by about 15 percent compared to the stride length SL2 as shown in FIG. 8, but the stride length SL3 of FIG. 9 is only increased by about 6 percent. That is, the stride length SL2 is increased more than the stride length SL3 while the swing axis 159 is being adjusted backwardly. Because both path inclination and stride length of the heel portion of a user are increased more than the toe portion, the exercise intensity of the heel portion is higher than the exercise intensity of the toe portion of a user which may also imply a higher exercise intensity of the gluteus of a user. Because the heel portion of the user is obviously elevated as shown in FIG. 7, the thigh of the user is elevated to a substantially horizontal orientation relative to the ground surface so that the gluteus of the user is fully exercised.

Now referring to FIGS. 10 through 13, a second preferred embodiment of the present invention is shown. A stationary exercise apparatus 200 comprises a frame 210 having a base portion 211 adapted to rest on a surface. The frame 210 further comprises a front portion 212 extending upwardly from the base portion 211, a side portion 214 extending longitudinally rearward from the front portion 212, and a rear portion 213 connecting the side portion 214 and the base portion 211.

The stationary exercise apparatus 200 further has first and second supporting members 220, each of the supporting members 220 having a first end portion and a second end portion. The first end portions of the first and second supporting members 220 are respectively pivoted to a pair of rotating members 233 in order to rotate about a first axis 234. The second end portions of the first and second supporting members 220 are respectively connected to the lower portions of first and second swing members 249. The upper portions of the first and second swing members 249 are coupled to the side portion 214 of the frame 210 via a swing axis 259. More specifically, the upper portions of the first and second swing members 249 are pivotally connected to left and right moving assemblies 241.

Each of the left and right moving assemblies 241 respectively comprises third and fourth moving members 242. Each of the third and fourth moving members 242 is connected to left and right adjusting assemblies 245 (FIG. 11) so that the moving assemblies 241 could be driven by the adjusting assemblies 245. Each of the left and right moving assemblies 241 further includes an optional roller 243. The rollers 243 are respectively engaged on the side portion 214 for increasing stability and smoothness of movement of the moving assemblies 241 along the side portion 214.

Figure 13:
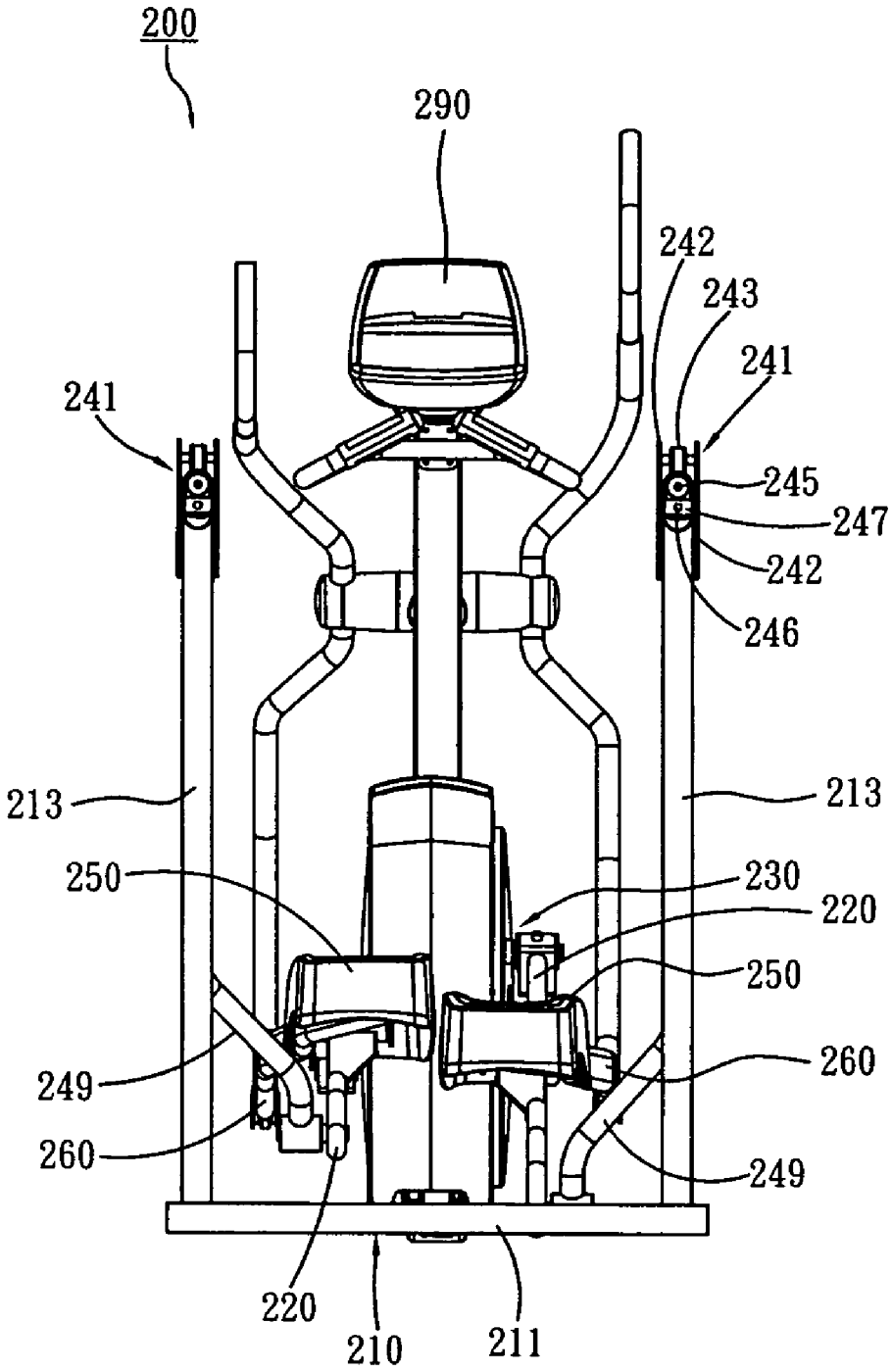
FIG. 13 is a back view of the stationary exercise apparatus of FIG. 10.

As illustrated in FIG. 13, each of the adjusting assemblies 245 includes a motor 246 mounted on one portion of the frame 210, a screw rod 247, and a screw member 248. The screw rod 247 has one end connected to the motor 246 and a portion adapted for movement of the screw member 248. Although described and illustrated as a screw adjusting mechanism, the adjusting assembly 245 could be any manual or automatic mechanical, electromechanical, hydraulic, or pneumatic device and be within the scope of the invention.

In the second preferred embodiment of the present invention, the upper portions of the first and second swing members 249 are respectively pivoted to the third and fourth moving members 242. But, the upper portions of the first and second swing members 249 can also be directly pivoted to the screw members 248 of the adjusting assemblies 245. Therefore, actuating of the motor 246 can cause rotation of the screw rod 247 to change the positions of both the third and fourth moving member 242 and the swing axis 259.

Similar to the previous preferred embodiment of the stationary exercise apparatus 100, the stationary exercise apparatus 200 also comprises a pair of pedals 250 respectively coupled to the supporting members 220. Optionally, the stationary exercise apparatus 200 also has a pair of control links 260 respectively pivoted to the supporting members 220 and a pair of handle links 271 coupled to the frame 210 for guiding the control links 260.

Figure 14:
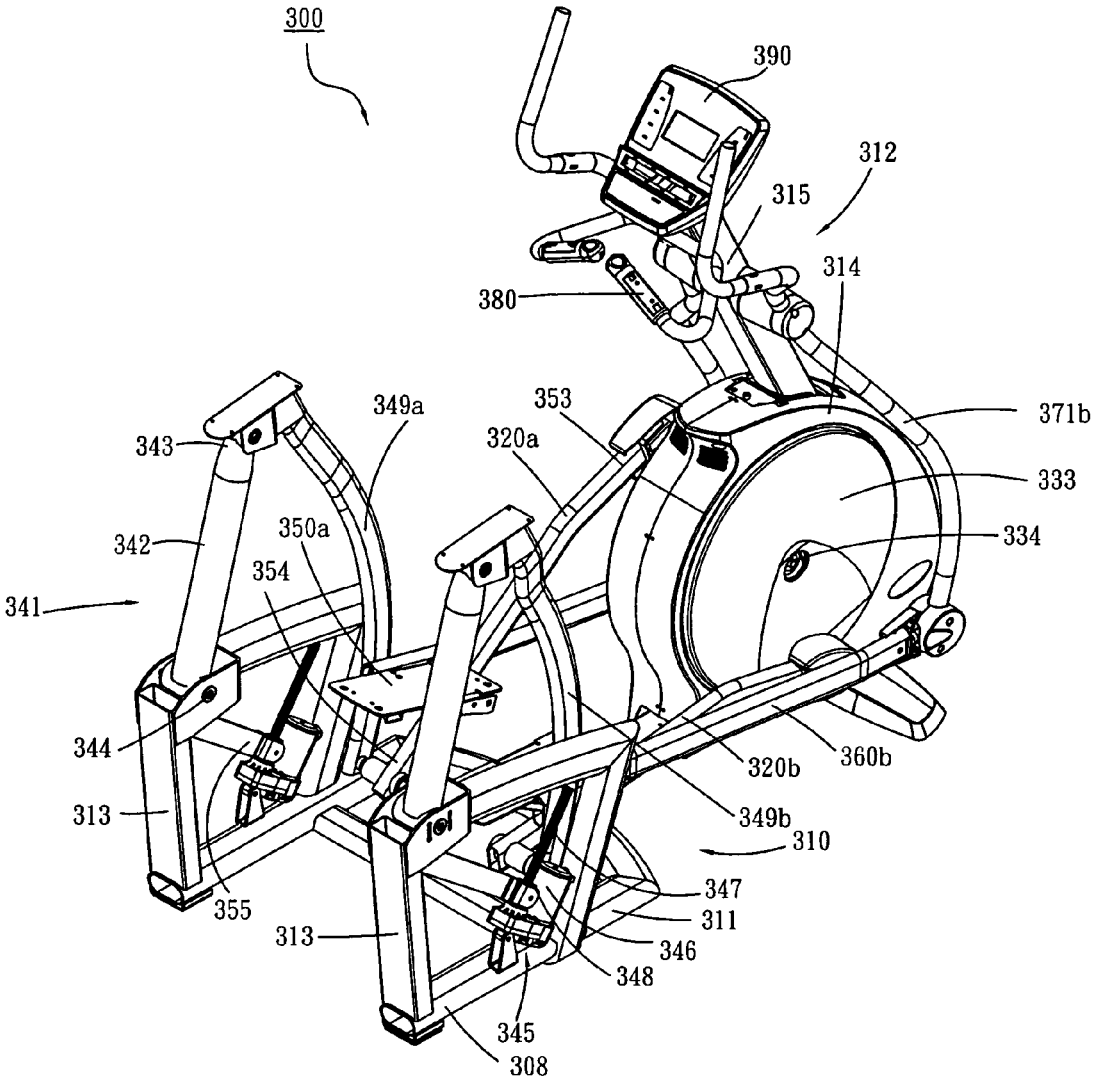
FIG. 14 is a perspective view of a third embodiment of a stationary exercise device in accordance with the present invention.
Figure 15:
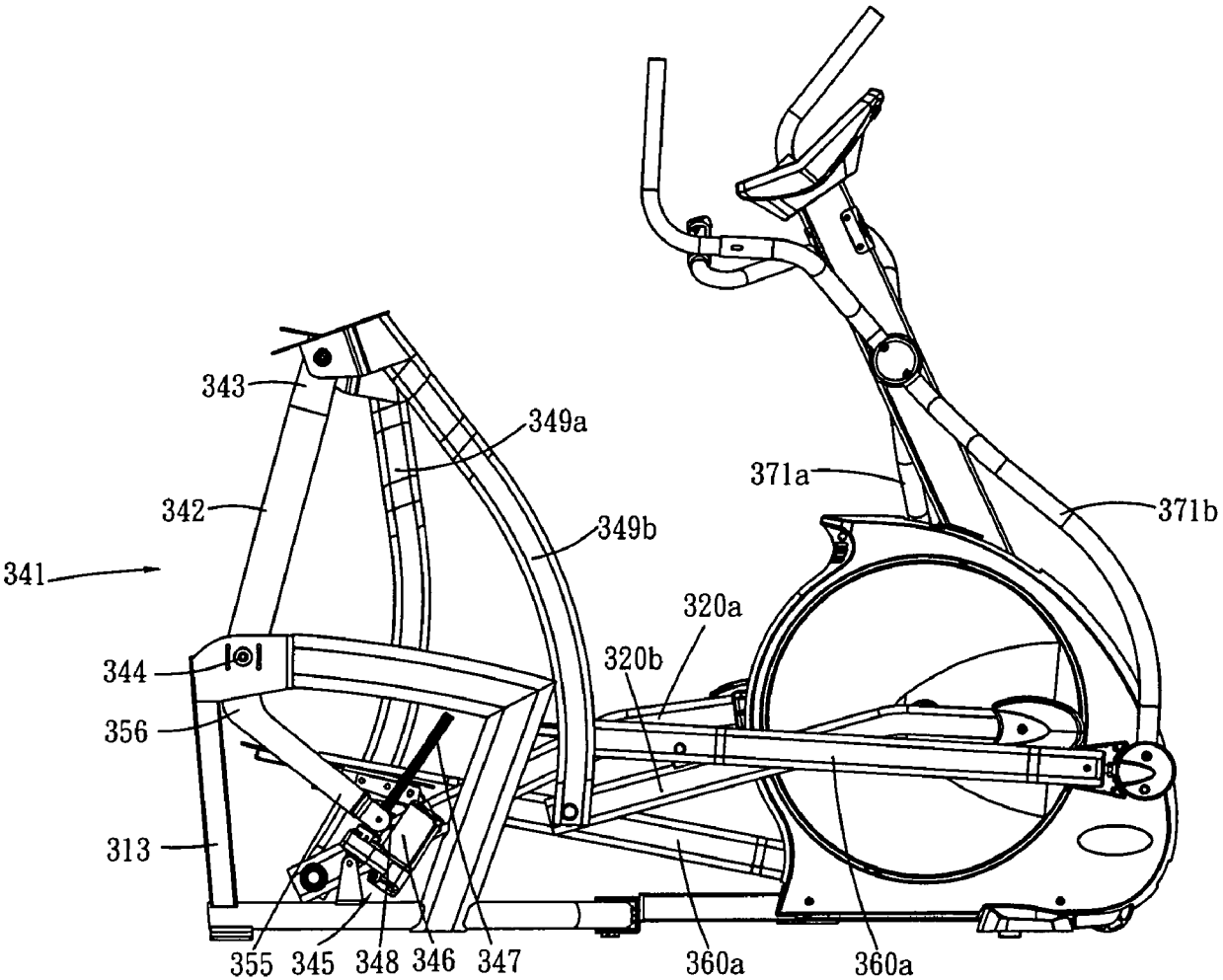
FIG. 15 is a side view of the stationary exercise apparatus of FIG. 14.
Figure 16:
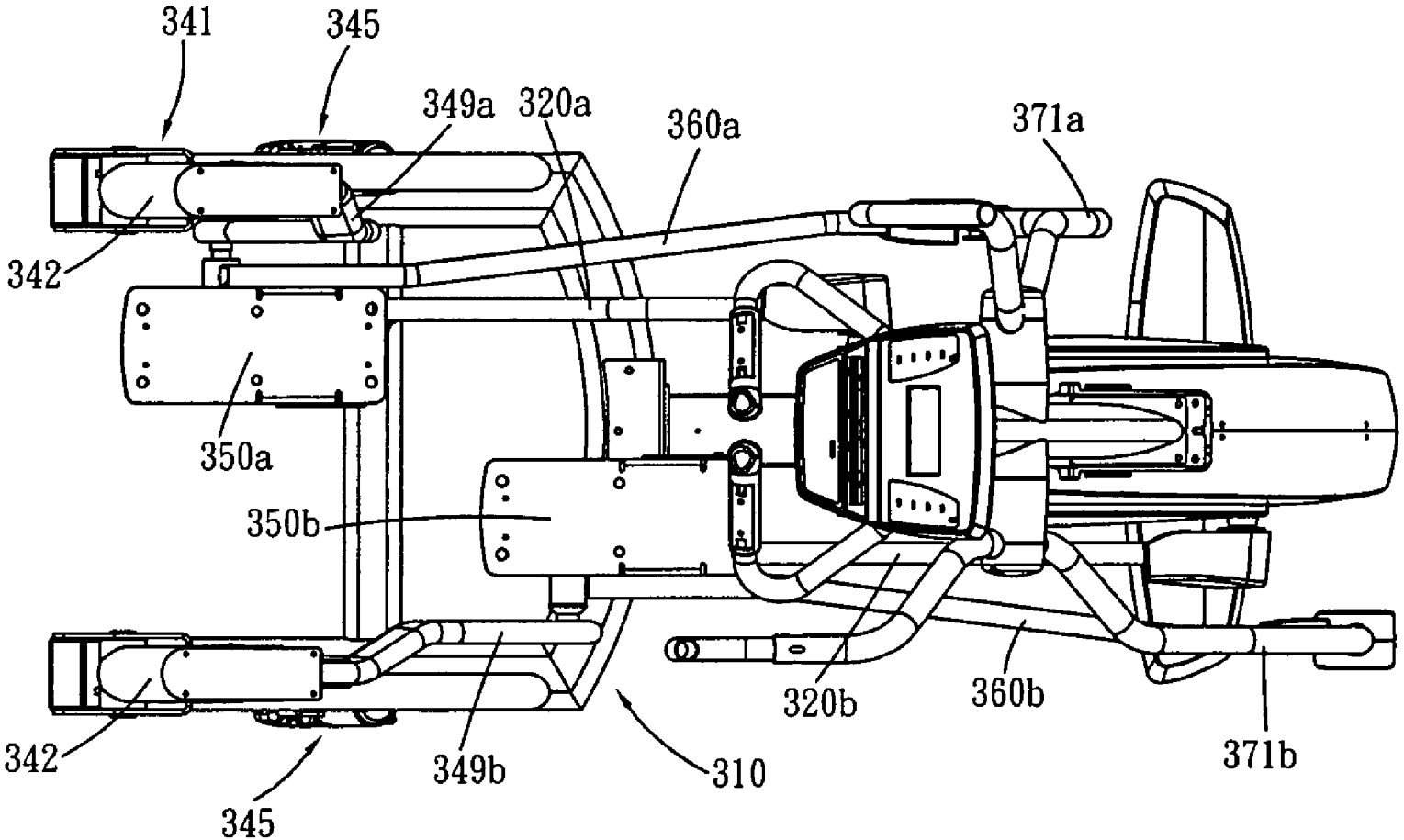
FIG. 16 is a top view of the stationary exercise apparatus of FIG. 14.

FIGS. 14 through 16 illustrate an embodiment similar to the embodiment illustrated in FIGS. 1 though 9. This third embodiment of a stationary exercise apparatus 300 includes a frame 310 having a base 311, a front portion 312, a rear portion 308, and side portions 313. The frame 310 may also include a post 314 and a standard 315. A handle assembly 380 and a console 390 are also provided as described above in relation to the first and second embodiments.

The third embodiment of the exercise apparatus 300 includes rotating members 333 that rotate about a first axis 334, similar to those described and illustrated in relation to the second embodiment 200 (FIGS. 10 through 13). An optional resistance member 135 is also provided.

Similar to the embodiment illustrated in FIGS. 1 to 9, the third embodiment of the exercise apparatus 300 also includes first and second supporting members 320*a*/320*b*, each having a first end portion 353 rotatably joined to the rotating members 333 and a second end portion 354. The second end portions 354 are respectively joined to swing members 349*a*/349*b*. The swing members 349*a*/349*b* are joined to the frame side portions 313 in a manner substantially similar to that described above in relation to the first embodiment 100.

There is also provided a moving assembly 341 including first and second moving member 342 that are defined by an upper portion 343 and a lower portion 355 joined at an elbow 356, so that the upper portion 343 and the lower portion 355 are at an angle to one another as illustrated. The first and second moving members 342 are joined to the side portions 313 via a second axis 344 to pivot as described above.

An optional adjusting assembly 345 is provided on each side of this embodiment 300. The adjusting assembly 345 activates the moving assembly 341 about the second axis 344. The adjusting assembly includes a motor 346, a screw rod 347, and a threaded nut, sleeve, or tube 348. The motor 346 is connected to the base 311 and to the screw rod 347. In this embodiment, the screw rod 347 is generally upright and angled slightly forward. The screw rod 347 is threaded through the tube 348, which is pivotally mounted on the lower portion 355 of the moving members 342. In this manner, the motor 346 can be activated automatically or manually from the console 390 to rotate the screw rod 347, which in turn raises or lowers the tube 348 along the screw rod 347. As the tube 348 is raised or lowered, the moving member 342 pivots about the second axis 344. A manually operated adjusting assembly could also be used, as described above.

First and second pedals 350*a*/350*b* are respectfully coupled to the first and second supporting members 320*a*/320*b*, either directly or indirectly. To couple the pedals 350*a*/350*b* indirectly to the support members 320*a*/320*b*, there are provided first and second control links 360*a*/360*b* which are pivotally connected to the support members 320*a*/320*b*. The pedals 350*a*/350*b* are joined to the control links 360*a*/360*b* and move in a second closed path when the support members 320*a*/320*b* move as described above.

Handle links 371*a*/371*b* are illustrated for this embodiment, and as with the above embodiments, may be substituted by tracks, rollers, sliders, and the like to provide support for the moving first end portions of the control links 360*a*/360*b*. Any such device is referred to herein as a "handle link" regardless of whether it actually serves as a handle for a user.

The previously described embodiments of the present invention have many advantages, including: (a) to provide a user of the stationary exercise apparatus with a benefit of high exercise intensity; (b) to provide a user of the stationary exercise apparatus with a benefit of an inclined foot path; (c) to provide a user of the stationary exercise apparatus with a benefit of an increased stride length; and (d) to provide a user of the stationary exercise apparatus with a benefit of better gluteus exercise. The present invention does not require that all the advantageous features and all the advantages need to be incorporated into every embodiment thereof. Although the present invention has been described in considerable detail with reference to certain preferred embodiment thereof, other embodiments are possible. Therefore, the spirit and scope of the appended claims should not be limited to the description of the preferred embodiment contained herein.

The invention claimed is:

1. A stationary exercise apparatus, comprising:

(a) a frame having a base, a side portion, a front, and a back;

(b) first and second supporting members, each supporting member having a first end portion and a second end portion, the first end portions of the first and second supporting members respectively coupled to the frame to rotate about a first axis;

(c) first and second swing members, each swing member having an upper portion and a lower portion, the lower portions of the first and second swing members respectively pivotally joined to the second end portions of the first and second supporting members, the upper portions of the first and second swing members respectively pivotally connected to the side portion of the frame at points that define a swing axis;

(d) first and second control links respectively pivotally connected to the first and second supporting members, each control link having a first end portion, a second end portion, and a central portion, wherein the first end portions of the first and second control links are movably coupled to the frame, the central portions of the first and second control links are respectively joined to the first and second supporting members so that the second end portion of each control link extends upwardly above the supporting members; and (e) first and second pedals respectively coupled to the second end portions of the first and second control links, the first and second pedals moving along a closed path while the first ends of the first and second supporting members are being rotated about the first axis and the second ends of the first and second supporting members are reciprocating with the lower portions of the first and second swing members.

2. The stationary exercise apparatus of claim 1, wherein the second end portions of the first and second supporting members define a reciprocating path having a front end, a middle point, and a rear end wherein the swing axis is positioned farther from the front of the frame than the middle point of the reciprocating path.

3. The stationary exercise apparatus of claim 1, wherein the second end portions of the first and second supporting members define a reciprocating path having a front end, a middle point, and a rear end wherein the swing axis is positioned farther from the front of the frame than the rear end of the reciprocating path.

4. The stationary exercise apparatus of claim 1, further comprising first and second handle links, each handle link having upper and lower end portions, the lower end portions of the first and second handle links respectively pivoted to the first end portions of the first and second control links, the upper end portions of the first and second handle links respectively pivoted to the frame.

5. The stationary exercise apparatus of claim 1, wherein the second end portions of the first and second supporting members define a reciprocating path having a front end, a middle point, and a rear end wherein the swing axis is disposed at substantially the same distance from the front end of the frame as the center point of the reciprocating path.

6. The stationary exercise apparatus of claim 1, wherein the swing axis is movable toward and away from the front of the frame.

7. A stationary exercise apparatus, comprising:

(a) a frame having a base, a side portion, a front, and a back;

(b) first and second supporting members, each supporting member having a first end portion and a second end portion, the first end portions of the first and second supporting members respectively coupled to the frame to rotate along a first closed path about a first axis;

(c) first and second swing members, each swing member having an upper portion and a lower portion, the lower portions of the first and second swing members respectively connected to the second end portions of the first and second supporting members, the upper portions of the first and second swing members being adjustably coupled to the side portion of the frame and defining a swing axis;

(d) first and second pedals respectively pivotally coupled to the first and second supporting members, the first and second pedals moving along a second closed path and a third closed path while the first ends of the first and second supporting members are being rotated about the first axis wherein at least one geometry parameter of the second closed path could be varied while the swing axis is being adjusted relative to the frame; and (e) first and second moving members respectively pivotally coupled to the frame, each moving member having an upper end portion, the upper end potions of the first and second moving members respectively coupled to the upper portions of the first and second swing members.

8. The stationary exercise apparatus of claim 7, wherein the geometry parameter is the incline level of the second closed path and the incline level of the second closed path could be increased while the swing axis is being adjusted rearwardly.

9. The stationary exercise apparatus of claim 7, and further comprising an adjustable assembly, one end of the adjustable assembly coupled to one of the first and second moving members, the other end of the adjustable assembly coupled to the frame.

10. The stationary exercise apparatus of claim 9, wherein the frame further comprises: third and fourth moving members slidably coupled to the frame, the third and fourth moving members respectively pivoted to the upper portions of the first and second swing members.

11. The stationary exercise apparatus of claim 10, wherein the frame further comprises at least an adjustable assembly coupled to one of the third and fourth moving members.

12. A stationary exercise apparatus, comprising:

(a) a frame having a base, a side portion, a front, and a back;

(b) first and second supporting members, each supporting member having a first end portion and a second end portion, the first end portions of the first and second supporting members respectively coupled to the frame to rotate along a first closed path about a first axis;

(c) first and second swing members, each swing member having an upper portion and a lower portion, the lower portions of the first and second swing members respectively connected to the second end portions of the first and second supporting members, the upper portions of the first and second swing members being adjustably coupled to the side portion of the frame and defining a swing axis;

(d) first and second control links respectively pivotally joined to the first and second supporting members, each control link having a first end portion and a second end portion, the first end portions of the first and second control links movably coupled to the frame; and (e) first and second pedals respectively coupled to the second end portions of the first and second control links, the first and second pedals moving along a second closed path and a third closed path while the first ends of the first and second supporting members are being rotated about the first axis wherein at least one geometry parameter of the second closed path could be varied while the swing axis is being adjusted relative to the frame and wherein the incline level of the second closed loop path is increased more than the incline level of the third closed loop path while the swing axis is being adjusted backwardly.

13. A stationary exercise apparatus, comprising:

(a) a frame having a base, a side portion, a front, and a back;

(b) first and second supporting members, each supporting member having a first end portion and a second end portion, the first end portions of the first and second supporting members respectively coupled to the frame to rotate along a first closed path about a first axis;

(c) first and second swing members, each swing member having an upper portion and a lower portion, the lower portions of the first and second swing members being respectively pivotally coupled to the second end portions of the first and second supporting members, the upper portions of the first and second swing members being adjustably coupled to the frame and defining a swing axis;

(d) first and second pedals; and (e) first and second control links respectively pivoted to the first and second supporting members, each control link having a first end and a second end, the first ends of the first and second control links movably coupled to the frame, the second ends of the first and second control links respectively coupled to the first and second pedals, the first and second pedals moving along a second closed loop path and a third closed loop path while the first ends of the first and second supporting members are being rotated about the first axis wherein at least one geometry parameter of the second closed loop path is increased while the swing axis is being adjusted rearwardly, the geometry parameter being selected from the group consisting of a stride length and pedal orientation steepness.

14. The stationary exercise apparatus of claim 13, the frame, and further comprising first and second moving members pivoted to the frame, each moving member having an upper end portion, the upper ends of the first and second moving members respectively coupled to the upper portions of the first and second swing members.

15. The stationary exercise apparatus of claim 14, and further comprising an adjustable assembly, one end of the adjustable assembly coupled to one of the first and second moving members and the other end of the adjustable assembly coupled to the frame.

16. The stationary exercise apparatus of claim 15, and further comprising first and second handle links, each handle link having an upper end and a lower end, the low ends of the first and second handle links respectively pivoted to the first end portions of the first and second control links, the up ends of the first and second handle link respectively pivoted to the frame.

17. The stationary exercise apparatus of claim 13, wherein the frame further comprises third and fourth moving members slidably coupled to the frame, the third and fourth moving members respectively pivoted to the upper portions of the first and second swing members.

18. The stationary exercise apparatus of claim 13, wherein the stride length of the second closed path is increased more than the stride length of the third closed path while the swing axis is being adjusted rearwardly.

* * * * *

UNITED STATES PATENT AND TRADEMARK OFFICE

CERTIFICATE OF CORRECTION

PATENT NO. : 7,682,290 B2
APPLICATION NO. : 11/434541
DATED : March 23, 2010
INVENTOR(S) : Hung-Mao Liao and Shu-Wei Chang It is certified that error appears in the above-identified patent and that said Letters Patent is hereby corrected as shown below:

In col. 10, line 42, claim 7 "potions" should be -- portions --.

Signed and Sealed this

Eleventh Day of May, 2010

David J. Kappos

David J. Kappos
*Director of the United States Patent and Trademark Office*